US006971522B2

(12) United States Patent
Yuyama et al.

(10) Patent No.: US 6,971,522 B2
(45) Date of Patent: Dec. 6, 2005

(54) TABLET CASE

(75) Inventors: Shoji Yuyama, Osaka (JP); Akitoshi Honryo, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/516,341

(22) PCT Filed: Mar. 2, 2004

(86) PCT No.: PCT/JP2004/002555

§ 371 (c)(1),
(2), (4) Date: Nov. 30, 2004

(87) PCT Pub. No.: WO2004/078095

PCT Pub. Date: Sep. 16, 2004

(65) Prior Publication Data

US 2005/0173290 A1 Aug. 11, 2005

(30) Foreign Application Priority Data

Mar. 5, 2003 (JP) ..... 2003-058608
Aug. 5, 2003 (JP) ..... 2003-286916

(51) Int. Cl.[7] ..... B65D 83/04
(52) U.S. Cl. ..... 206/538; 206/540
(58) Field of Search ..... 206/528–540; 312/198, 201, 237, 242

(56) References Cited

U.S. PATENT DOCUMENTS 3,833,143 A * 9/1974 Starkermann et al. ..... 206/538
5,159,581 A * 10/1992 Agans ..... 206/538
5,275,291 A * 1/1994 Sledge ..... 206/540
5,379,899 A * 1/1995 Thurell ..... 206/538
6,662,081 B1 * 12/2003 Jacober et al. ..... 206/528
2002/0093429 A1 * 7/2002 Matsushita et al. ..... 340/573.1

FOREIGN PATENT DOCUMENTS

| | | |
|---|---|---|
| JP | 57-65641 | 4/1982 |
| JP | 59-103662 | 7/1984 |
| JP | 11-9663 | 1/1999 |
| JP | 2001-104063 | 4/2001 |

* cited by examiner

*Primary Examiner*—Luan K. Bui
(74) *Attorney, Agent, or Firm*—Wenderoth, Lind & Ponack, L.L.P.

(57) ABSTRACT in a pill case 1 comprising left and right side walls 4*a*, 4*b*, a rear wall 5 continued from the left and right side walls 4*a*, 4*b* and a bottom plate 6 provided between the left and right side walls 4*a*, 4*b* in the upper position of the lower ends of the left and right side walls 4*a*, 4*b* having an inclined face 9 obliquely upwardly inclined toward the front side from the rear wall 5, and the pill case 1 storing blister packs 30 put on the inclined face 9 of the bottom plate 6, a drawer 3 is placed in a space positioned below the bottom plate 6 and defined by the left and right side walls 4*a*, 4*b* and the bottom plate 6, so that the drawer 3 can be drawn toward the front. On the inside of left and right side walls 4*a*, 4*b* is provided at least a pair of opposed vertical groves 22. And at least one pair of opposed vertical groves 22 formed on inside of the left and right side walls 4*a*, 4*b* and a movable wall 21 engaging with the vertical groves 22 to separate the space above the inclined face 9 of the bottom plate 6 into a front space and rear space.

8 Claims, 11 Drawing Sheets

TABLET CASE

TECHNICAL FIELD

This invention relates to a pill cases to store pill blister packs put onto.

BACKGROUND ART

Conventionally, as shown in FIG. 15, a pill rack 33 having multiple shelves 31 with a plurality of pill cases 32 placed on has been installed in a hospital or a dispensary. When pills are purchased, pill blister packs are taken out from the packaging box to be stored in the pill case 32 by category. As shown in FIG. 16, the pill case 32 comprises left and right side walls 34*a*, 34*b*, a rear wall 35 continued from the rear end of the left and right side walls 34*a*, 34*b* and a bottom plate 36 provided in a position spaced from the bottoms of the left and right side walls 34*a*, 34*b* and between the left and right side walls 34*a*, 34*b*. The bottom plate 36 has an inclined face 37 inclined upwardly toward the front side from the rear wall 35. The pill blister packs are put on the inclined face 37 to be stored and odd pill blister packs are stored in a small storage part 38 provided in front of and below the inclined face 37 (e.g. see Japanese unexamined patent publication No. H11-9663).

However, the conventional pill case 32 has no space for storing such as description packed together with the pill blister packs in the packaging box. Therefore, some pill cases provided with a space for inserting the description in under the storage part 38 for the odd pill blister packs has been proposed (e.g. see Japanese. unexamined patent publication No. 2001-104063), but yet the space has not been sufficient. Although there has been in practical use a pill case with a drawer provided below the conventional pill case 32, the height of the pill case has been increased by a dimension of the provided drawer, enlarging the pill rack.

In the case where the blister pack 30 put onto the inclined face 37 of the bottom plate 36 is considerably shorter than the length of the bottom plate 36. Therefore the conventional pill case 32 has a problem of difficulty in picking up a pill blister pack 30 because of the necessity of inserting a hand into narrow space to pick up the pill blister pack 30, the blister pack 30 is put on so that the front end of the blister pack 30 is positioned at the rear portion apart from the front edge of the bottom plate 3*b*. Moreover, in the case where the width of the blister pack 30 is nearly wider with the width of the bottom plate 36, due to the impossibility in inserting fingers into the sides of the blister pack 30, it has also a problem of difficulty in picking up a pill blister pack 30 because of the necessity of pinching out from the front side.

DISCLOSURE OF INVENTION

The present invention has been accomplished in contemplation of aforesaid problems of the conventional pill cases and an object of the invention is to provide a pill case which has a space to store a description of the pill or others without any change in the whole shape of conventional pill cases. Another object of the invention is to provide a pill case in which stored pills can be picked up easily.

To solve aforesaid problems, according to the present invention, in a pill case comprising left and right side walls, a rear wall continued from the left and right side walls and a bottom plate provided between the left and right side walls in the upper position of lower ends of the left and right side walls having an inclined face obliquely upwardly inclined toward the front side from the rear wall, and the pill case storing blister packs put on the inclined face of the bottom plate, a drawer is placed in a space positioned below the bottom plate and defined by the left and right side walls and the bottom plate, so that the drawer can be drawn toward the front side.

In this invention, in the space defined by the left and right side walls placed bellow the bottom plate and the bottom plate, a drawer, which can be drawn to the front side, is provided, therefore the pill case is unchanged from the conventional pill case in whole shape. And in the drawer, a sufficient space is reserved, so that description of the pill or others can be stored.

Guides may be provided at the lower end of the left and right side walls to support the drawer from below. Thereby the drawer can be drawn, which prevents dropping of the drawer out while the pill case is carried up.

A separating plate may be provided to separate the inner space of the drawer into a first storage part being in front of the front edge of the bottom plate and a second storage part below the bottom plate within the drawer put into the pill case. As the first storage part positions forward from the bottom plate and opens upwardly, odd blister packs can be stored into and taken out from the first storage part easily. The description of the pill or others can be stored in the second storage part.

Protrusions may be provided on both side walls of the drawer and elongate holes formed on the side walls in the drawn direction of the drawer to engage with the protrusions of the drawer. Thereby it is possible to prevent pulling of the drawer from pulling away from the pill case.

The elongate holes may be inflected so that the elongate holes each comprise a rear hole part inclined in parallel with the bottom plate and a front hole part extending horizontally from the front end of the rear hole part. Thereby a gap between the rear wall of the drawer and the bottom plate is smaller in a state of that the drawer is drawn out, which prevents anything stored from being caught into the gap or dropping over into the back space of the drawer.

An engagement portion may be provided on the left and right side walls or the bottom plate, and a latch portion may be provided on the drawer, the latch portion engaging with the engagement potion in a state of that the drawer is closed. Thereby it is possible to prevent to unnecessary drawing of the drawer while the pill case is carried up or put on a pill rack.

The left and right side walls each may comprise a rear part, a front part having a height of about half of the rear part and step part between the rear part and the front part, wherein the step part is placed at a position ⅓ to ½ of the total length of the bottom plate from the front edge of the bottom plate. Because of the shape of the left and right side walls that the upper portion of the front part is cut away widely, the pill blister packs can be picked up by fingers reaching onto the left and right side of the pill blister packs, even if the pill blister packs placed on the inclined face of the bottom plate were wide.

At least one pair of opposed vertical groves may be formed on inside of the left and right side walls and a movable wall may engage with the vertical groves to separate the space above the inclined face of the bottom plate into a front space and a rear space. Thereby the movable plate is engaged with the vertical groves to choose the depth of the space upon the inclined face adapting the length to the pill blister packs to be placed on the inclined face of the bottom plate. Therefore the blister packs can be placed in a position easy to be picked up as that the front edges of the blister packs are nearly aligned with the front edge of the bottom plate.

According to the present invention, the drawer, which can be drawn out to front side, is provided in the space defined by the left and right side walls placed bellow the bottom plate and the bottom plate. Therefore an enough space is reserved in the drawer to store the description of the pill or others without reconfiguration of whole shape from the conventional pill cases.

Moreover, the left and right side walls are shaped so that the upper portion of the front part is cut away widely, thereby the blister packs can be picked up by fingers reaching onto sides of the front part of the blister packs without the side walls existing proximately. The movable wall is engaged with the vertical groves to choose the depth of the space on the inclined face adapting the length to align the front edges of the pill blister packs placed with the front edge of the bottom plate. Therefore the blister packs can be picked up easily.

BEST MODE FOR CARRYING OUT THE INVENTION

Hereinafter, embodiments according to the present invention will be described with reference to the attached drawings.

Figure 1:
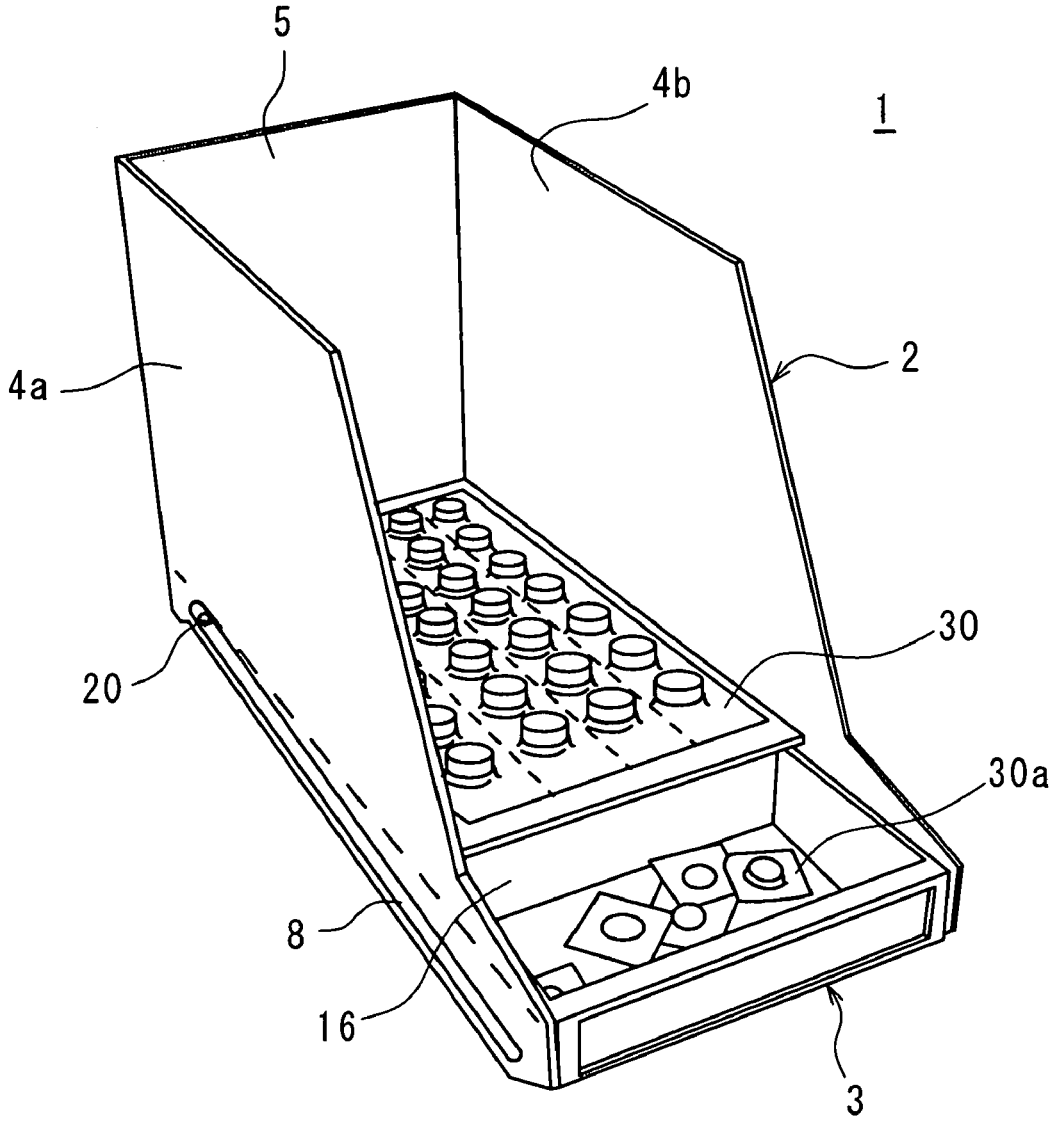
FIG. 1 is a perspective view of a pill case as a first embodiment according to the present invention showing a state of the drawer closed.
Figure 2:
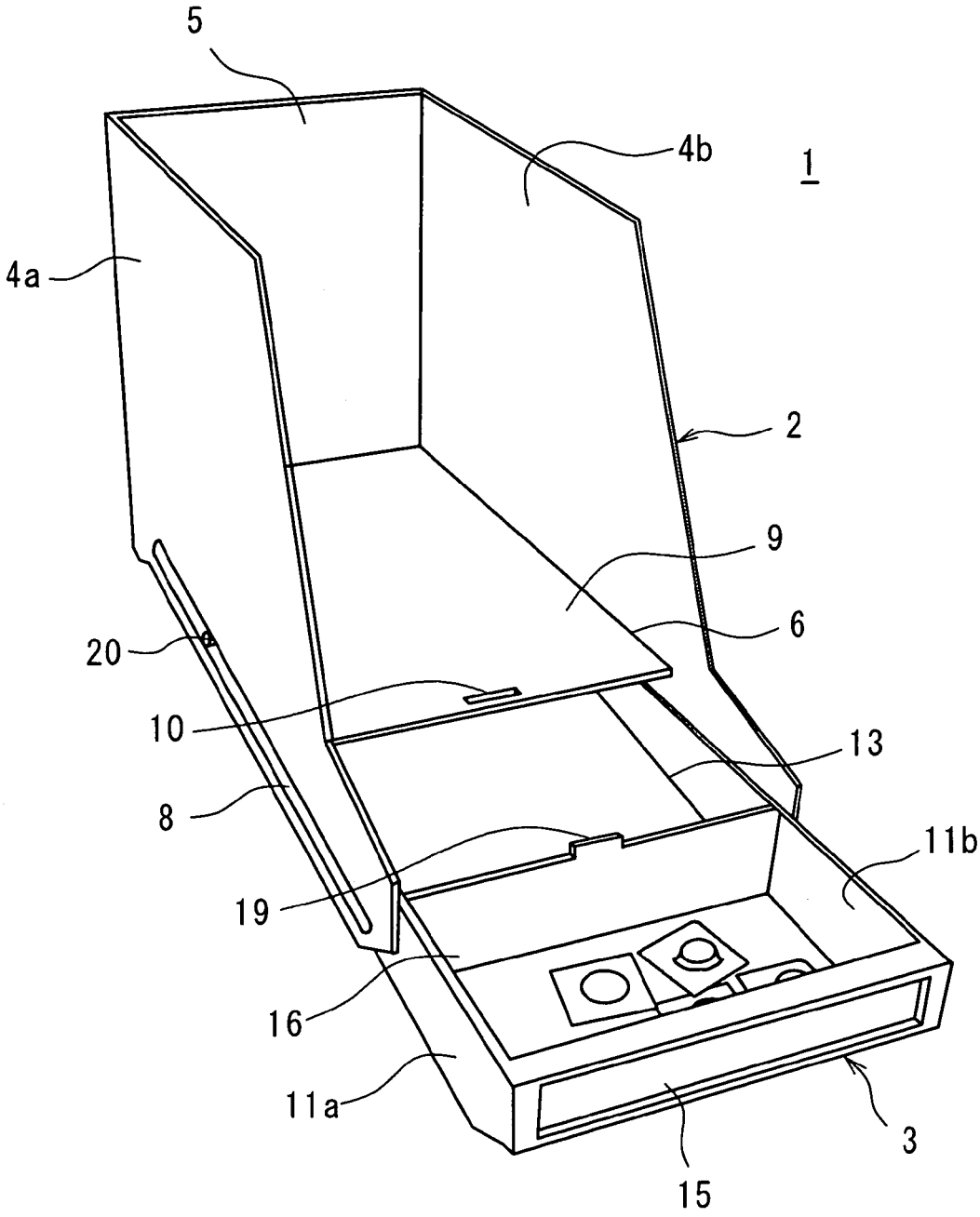
FIG. 2 is a perspective view of the pill case of FIG. 1 showing a state of the drawer drawn out.
Figure 15:
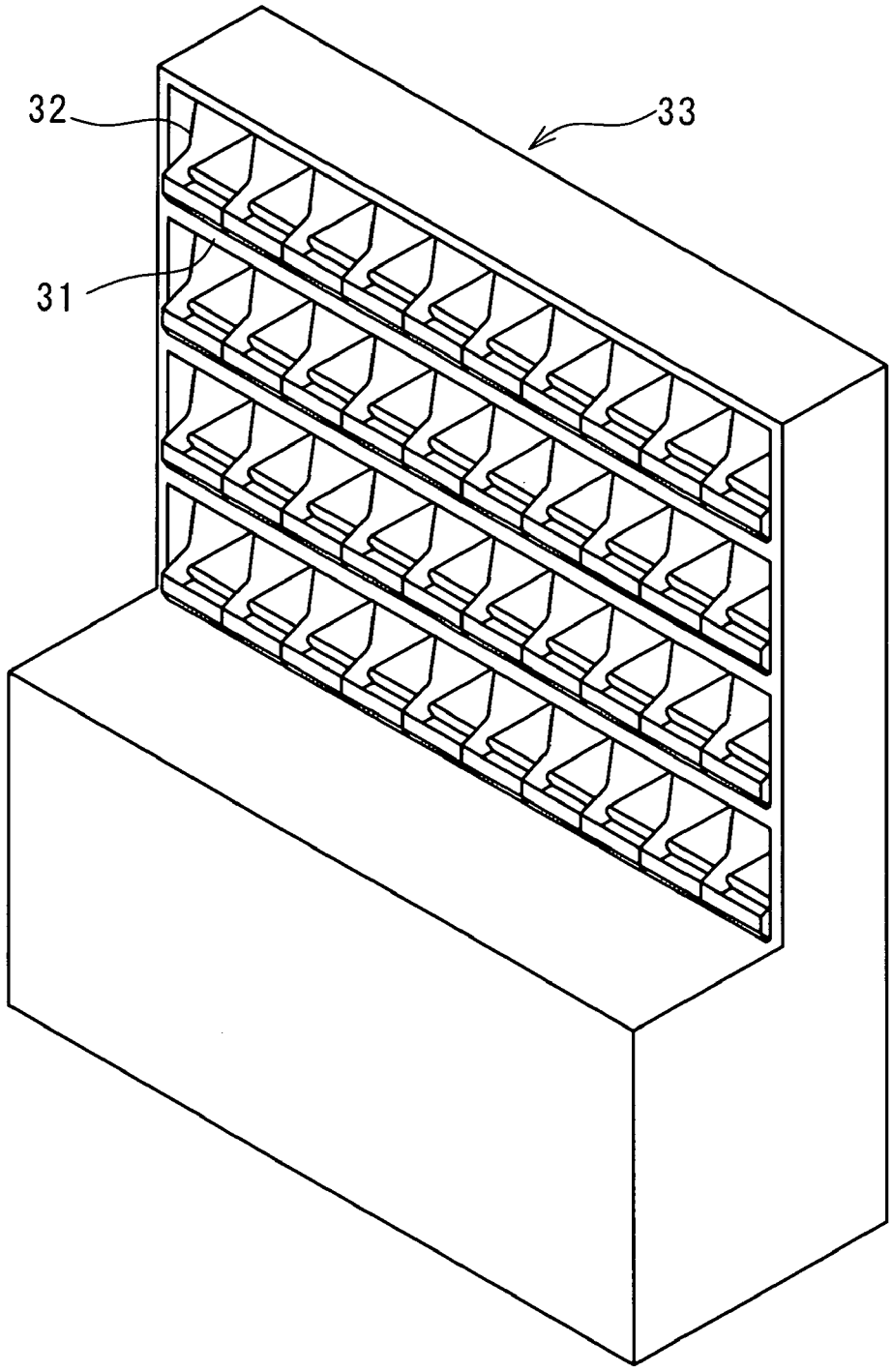
FIG. 15 is a perspective view of a pill rack on which conventional pill cases are put onto.

FIG. 1 shows a pill case 1 as a first embodiment according to the present invention. The pill case 1 is made of transparent or light blocking synthetic resin and placed on a pill rack 33 as shown in FIG. 15 to store a variety of pill blister packs in a similar way to conventional one. As shown in FIG. 2, the pill case 1 comprises a case body 2 and a drawer 3.

Figure 3:
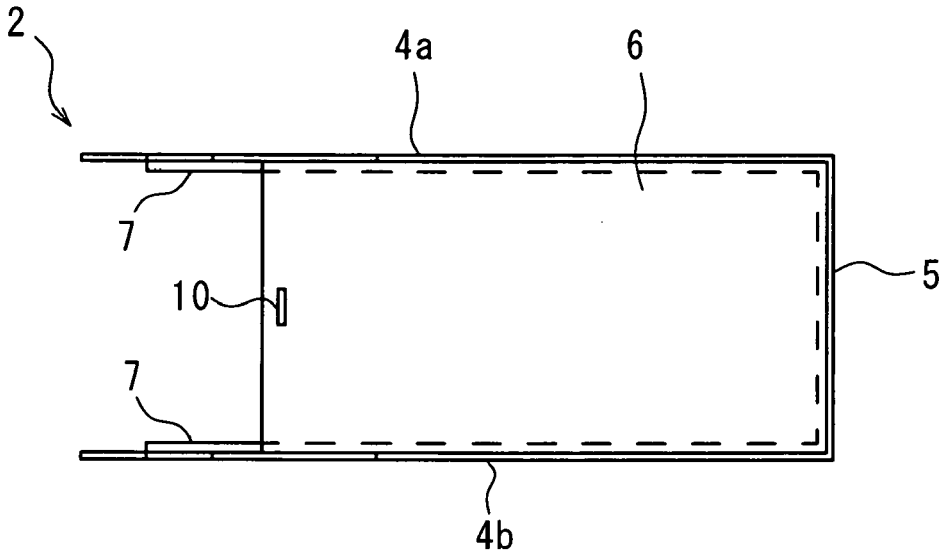
FIG. 3 is a plan view of a case body of the pill case of FIG. 1.
Figure 4:
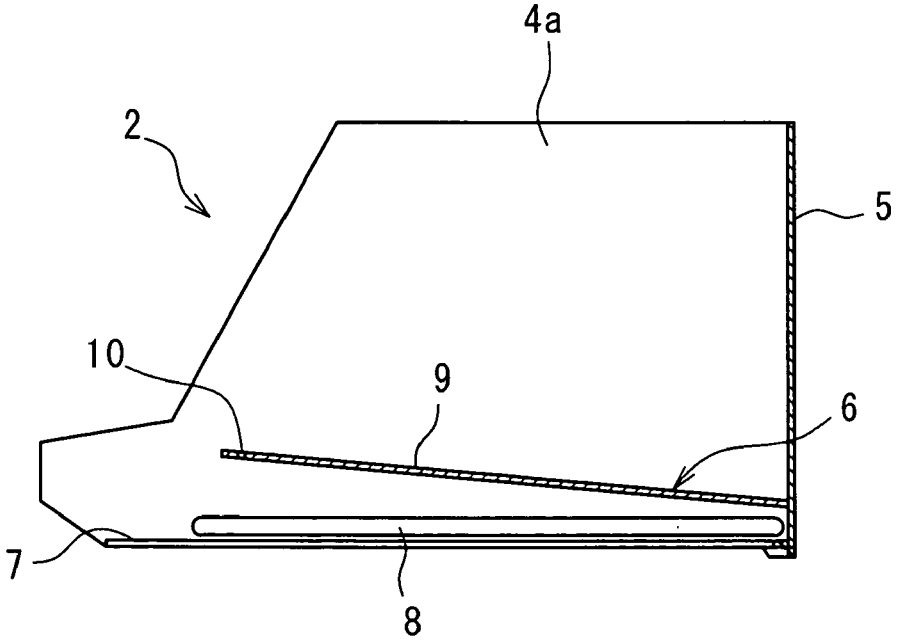
FIG. 4 is a sectional view of the case body of FIG. 3.

As FIG. 3 and FIG. 4 shows, the case body 2 comprises left and right side walls 4*a*, 4*b*, a rear wall 5 continued from the left and right side walls 4*a*, 4*b* and a bottom plate 6 provided between the left and right side walls 4*a*, 4*b* in the upper position of the lower ends of the left and right side walls 4*a*, 4*b*. Guides 7 projecting inside and extending backward and forward are formed at the lower ends of the left and right side walls 4*a*, 4*b*. Elongate holes 8 extending backward and forward are formed above the guides 7. The bottom plate has an inclined face 9 inclined upwardly toward the front side from the rear wall 5. The front edge of the bottom plate 6 hasn't reached and stopped short of the front edges of the left and right side walls 4*a*, 4*b*. A slot-shaped engagement hole 10 is formed at the middle of the front edge of the bottom plate 6.

Figure 5:
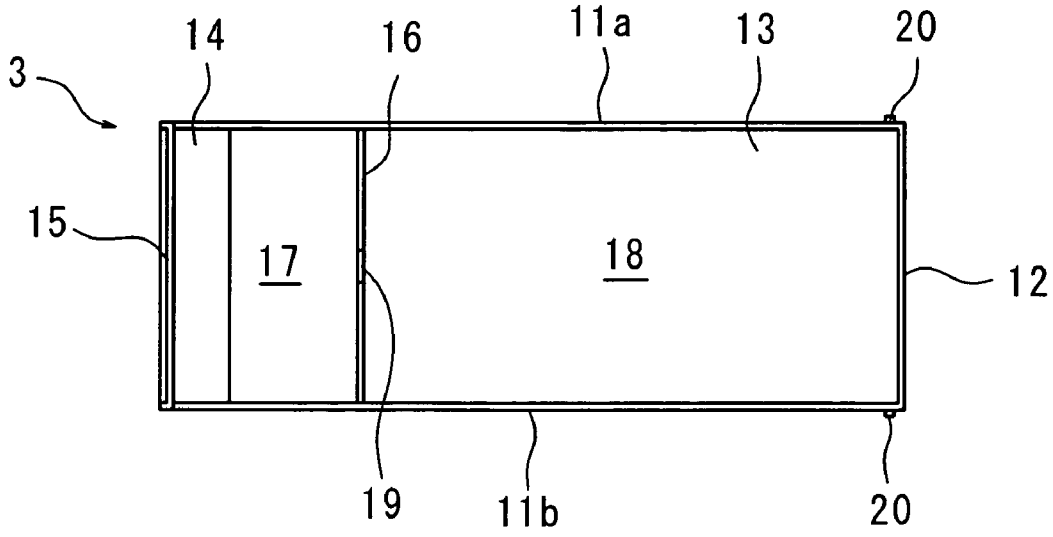
FIG. 5 is a plan view of the drawer of the pill case of FIG. 1.
Figure 6:
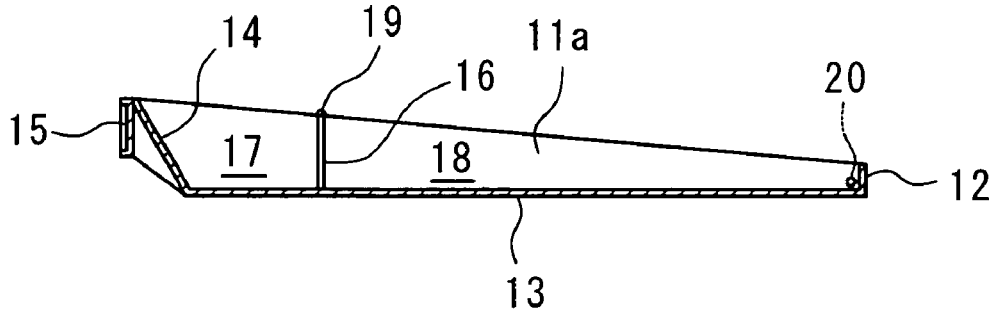
FIG. 6 is a sectional view of the drawer of FIG. 5.

The drawer 3 is drawably contained into a space defined by the bottom plate 6 of the case body 2 and the portions of left and right side walls 4*a*, 4*b* below the bottom plate 6. As FIG. 5 and FIG. 6 shows, the drawer 3 comprises left and right side walls 11*a*, 11*b* with upper edges inclined upwardly toward front side, a rear wall 12 continued from the rear ends of the left and right side walls 11*a*, 11*b* and a bottom plate 13 spreading between the left and right side walls 11*a*, 11*b* and the rear wall 12. The front end portion of the bottom plate 13 is comprised of an inclined face 14 extending obliquely upwardly to the top ends of the left and right side walls 4*a*, 4*b*. From the top end of the inclined face 14 a front plate 15 is extended downwardly on which a label for indication of the name of the pill or others is stuck. The space between the front plate 15 and the inclined face 14 serves as a pull handle which is used when drawing the drawer 3. The space defined by the left and right side walls 4*a*, 4*b*, the rear wall 12 and the bottom plate 13 is separated by a separation plate 16 provided on the bottom plate 13 to form a first storage part 17 positioned in front of the separation plate 16 and ahead of the front end of the bottom plate 6 and a second storage part 18 positioned behind the separation plate 16 and under the bottom plate of the case body 2. At the middle of the upper end of the separation plate 16, a projecting lug 19 is formed for engaging with the engagement hole 10 on the bottom plate 6 of the case body 2. As described above, the front edge of the bottom plate 6 is terminated in the middle of the left and right side walls 4*a*, 4*b*. Therefore the engagement hole 10 on the front edge can engage with the projecting lug 19 of the separation plate 16, allowing the first storage part 17 to open and the second storage part 18 to close. In the vicinity of the rear ends of the left and right side walls 11*a*, 11*b*, protrusions 20 are formed so as to protrude outwardly. The protrusions 20 are adapted to engage with the elongate holes 8 of the case body 2.

Figure 7:
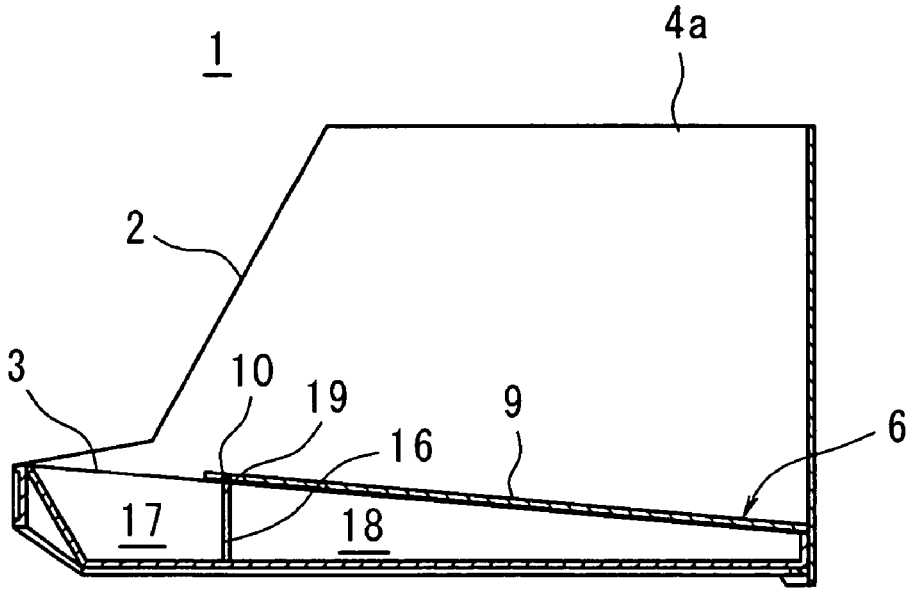
FIG. 7 is a sectional view of the drawer of the pill case of FIG. 1 showing a state of the drawer closed.

A plurality of pill cases 1 each having aforesaid construction are placed on the pill rack 33 such as shown in FIG. 15 and each of them can contain a different kind of pill blister pack 30. As shown in FIG. 1, the unused pill blister packs 30 are stacked on the inclined face 9 of the bottom plate 6 of the case body 2 while the separated odd pill blister packs 30*a* are contained in the first storage part 17 of the drawer 3. Draw of the drawer 3 causes the second storage part 18 to appear as shown in FIG. 2. In the second storage part 18, the description of the pill and if necessary a piece of paper on which information of expiration control and contraindications have noted are stored. With the drawer 3 closed as FIG. 7 shows, the projecting lug 19 on the separation plate 16 of the drawer 3 engages with the engagement hole 10 on the bottom plate 6 of the case body 2, preventing the drawer 3 from dropping out from the case body 2 as the pill case 1 is placing on or carried out from the pill rack 33. When the drawer 3 is drawn entirely, the protrusions 20 on the drawer 3 abut against within the front end of the elongate hole 8 on the case body 2, preventing the drawer 3 from dropping away.

Figure 16:
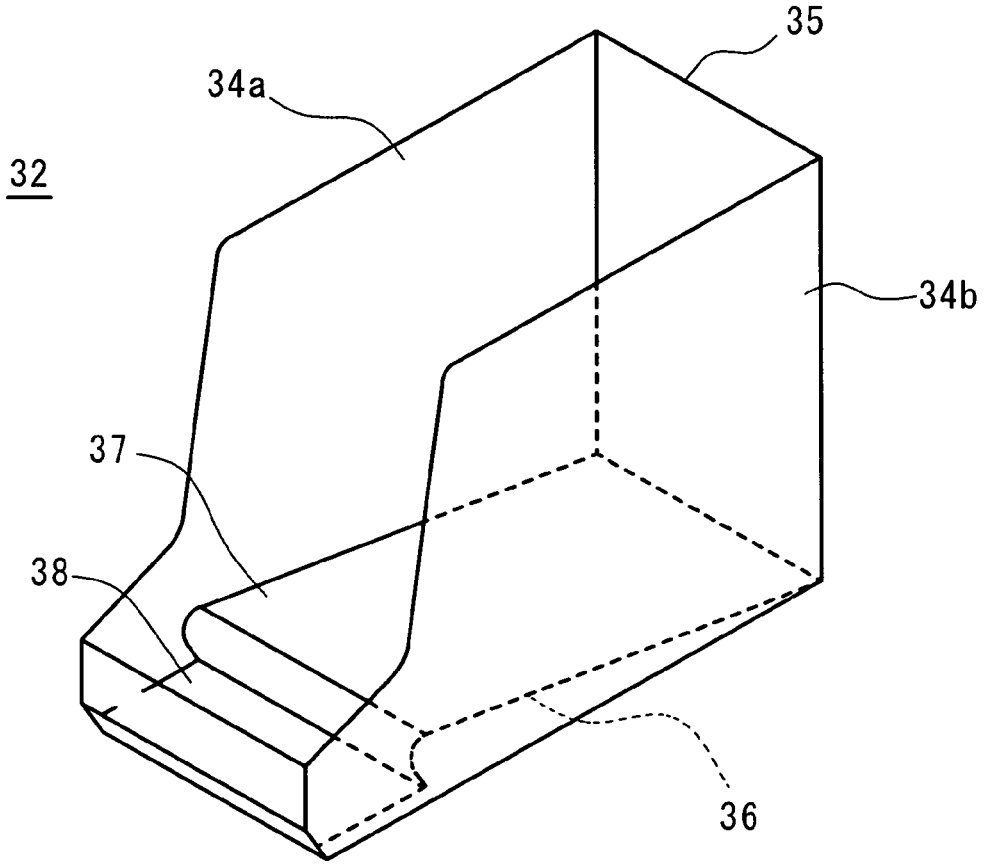
Fig. 16 Prior Art
FIG. 16 is a perspective view of the conventional pill case.

The space below the bottom plate 6 of the case body 2 is one defined inevitably by providing the bottom plate 6 with the inclined face 9 and such space also exists in the conventional pill case 32 as shown in FIG. 16. The drawer 3 according to the present invention is disposed in the space below the bottom plate 6 of the case body 2, making the whole shape of the case unchanged from the shape of the conventional pill case 32. Particularly the drawer 3 can be provided with the height of the pill case 1 kept equally. Therefore the same number of the pill case 1 as the conventional cases can be placed on the pill rack 33 similar to conventional one. In addition to functions that the bottom plate 6 can store the pill blister packs 30 and the first storage part 17 of the drawer 3 can store the odd pill blister packs 30*a*, a novel function that the second storage part 18 of the drawer 3 can store the description of the pill can be provided without any change of the whole shape.

Figure 8:
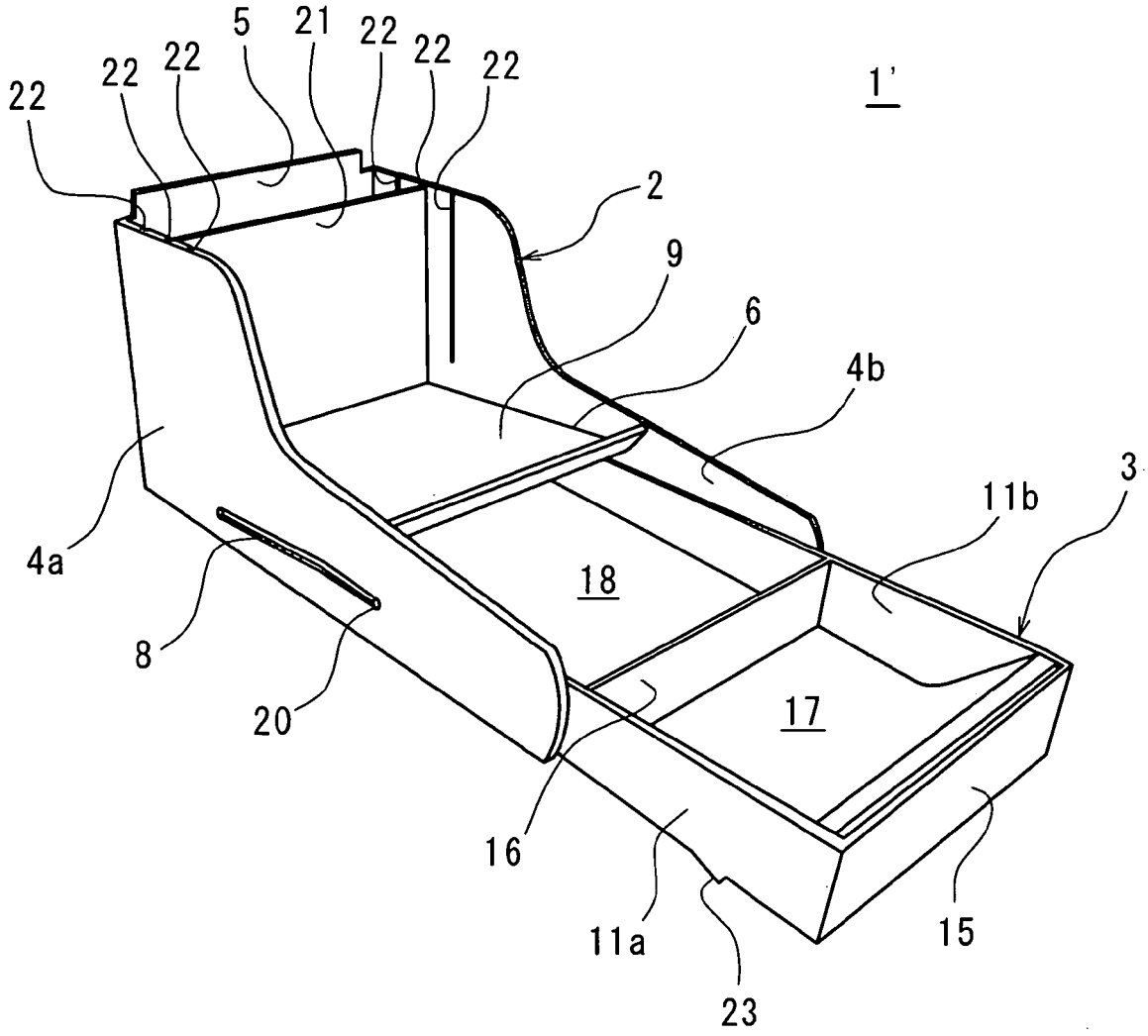
FIG. 8 is a perspective view of the pill case as a second embodiment according to the present invention showing a state of the drawer drawn out.

FIG. 8 shows a pill case 1' as a second embodiment according to the present invention. As far as the pill case 1', same numeral numbers are affixed to some components having same function as that of the aforesaid pill case 1 to omit descriptions. Therefore functions of only different component will be described.

The pill case 1' comprises a case body 2 and a drawer 3 and also has a movable wall 21.

Figure 9:
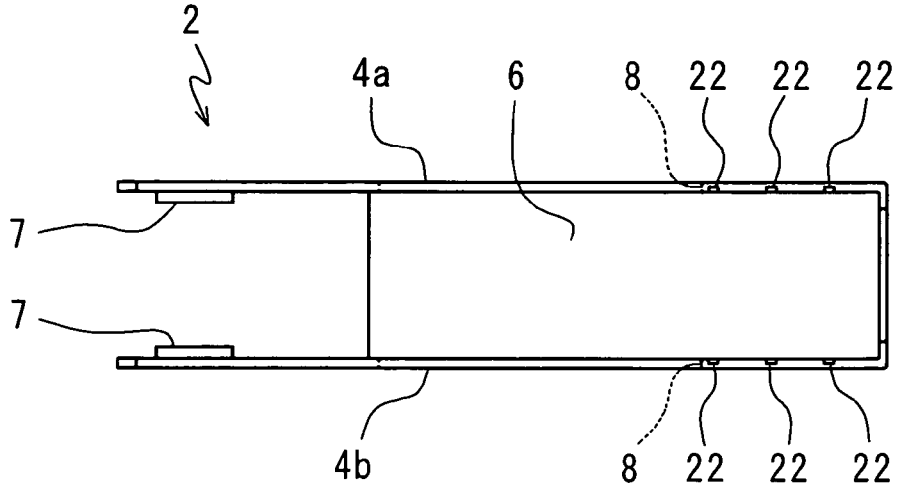
FIG. 9 is a plan view of a case body of the pill case of FIG. 8.
Figure 10:
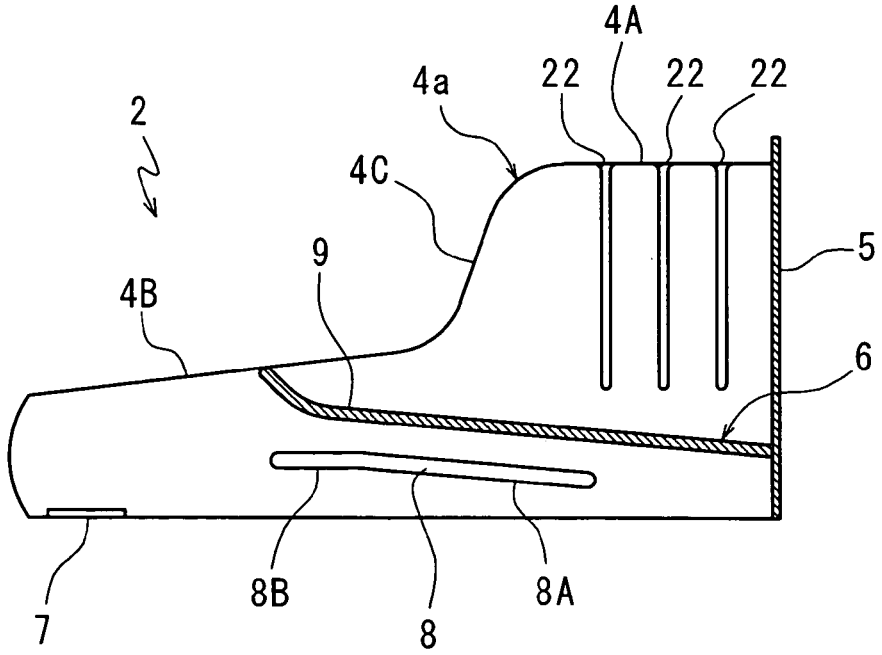
FIG. 10 is a sectional view of the case body 6*f* FIG. 9.

As FIGS. 9, 10 show, 3 pairs of vertical groves 22 opposed to each other are formed on the left and right side walls 4*a*, 4*b* of the case body 2 so that a movable wall 21 can be inserted into the vertical groves 22 from upper side. Elongate holes 8 formed on the left and right side walls 4*a*, 4*b* are inflected so that the each of elongate holes comprising a rear hole part 8A inclined in parallel with the bottom plate 6 and a front hole part 8B extending horizontally from the front end of the rear hole part 8A as shown in FIG. 10. Guides 7 are also formed in a shape of a claw narrower than that in the first embodiment. The left and right side walls 4*a*, 4*b* comprise a rear part 4A, a front part 4B having a height of about half of the rear part 4A and a step part 4C between the rear part 4A and the front part 4B. The step part 4C is placed at a position about ⅓ to about ½ length of the total length of the bottom plate 6 from the front edge of the bottom plate 6. The front end of the bottom plate 6 is inclined more upwardly to make it ensure to pick up the stored blister packs 30.

Figure 11:
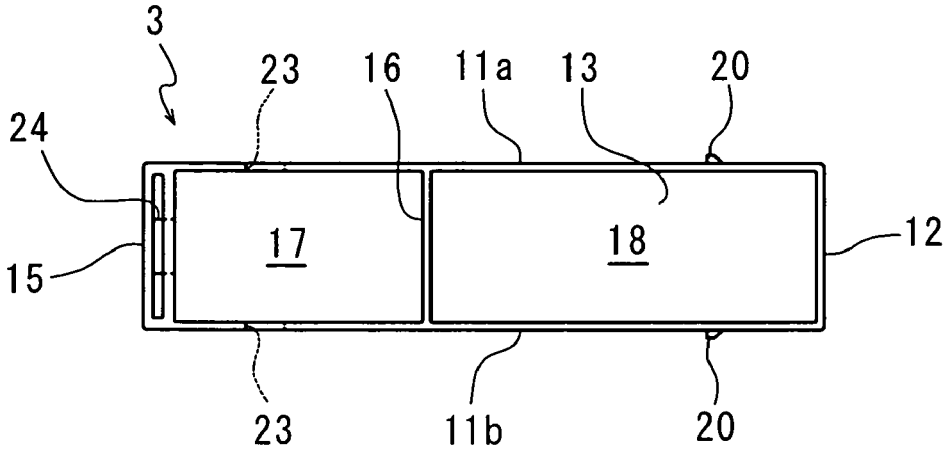
FIG. 11 is a plan view of the drawer of the pill case of FIG. 8.
Figure 12:
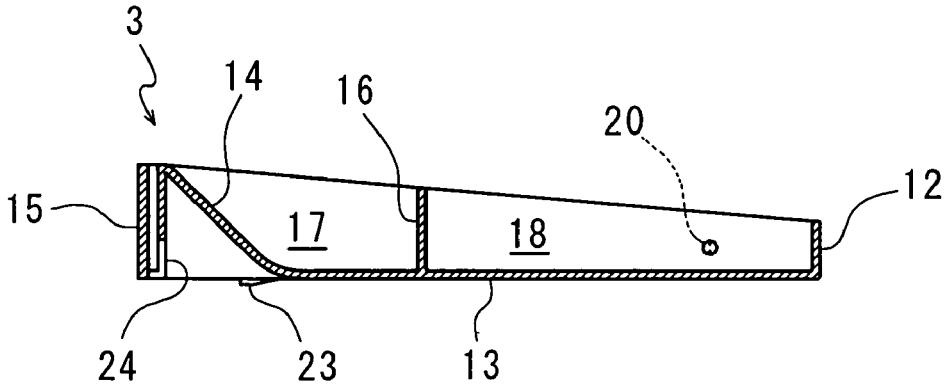
FIG. 12 is a sectional view of the drawer of FIG. 11.

As shown in FIG. 11 and FIG. 12, engagement claws 23 are also formed on the lower edges proximally to the front edges of the left and right side walls 11*a*, 11*b* on both sides of the bottom face of the drawer 3. Additionally, the front plate 15 has a "U" shape of cross-section so that a label indicated the name of the pill or others can be inserted from upper side. At the middle of the back side of the front plate 15 a cutout 24 in which a finger can be inserted to push out the label from lower side is further formed for taking the label away.

Figure 13:
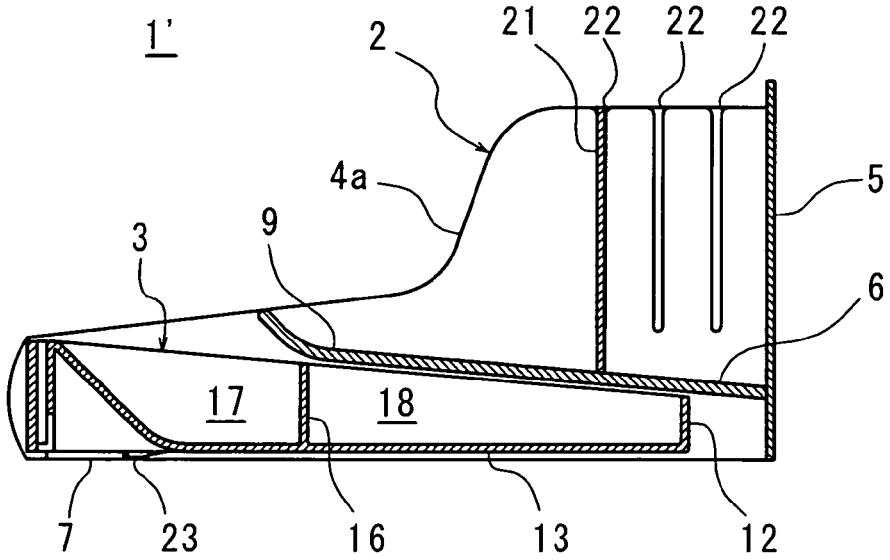
FIG. 13 is a sectional view of the pill case of FIG. 8 showing a state of the drawer closed.

As FIG. 13 shows a state of the pill case 1' with the drawer 3 closed, the engagement claws 23 of the drawer 3 is positioned behind the guides 7 of the case body 2 so that the guides 7 engage with the engagement claws 23. Therefore it is prevented that the drawer 3 is pull out unintentionally.

Figure 14:
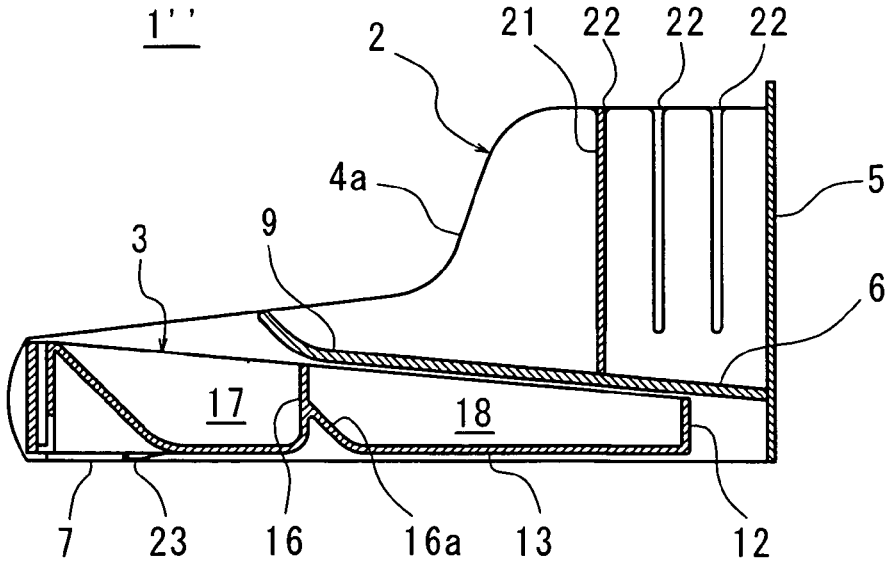
FIG. 14 is a sectional view of the pill case as a third embodiment according to the present invention with the drawer closed.

A plurality of pill cases 1' each having aforesaid construction are placed on the pill rack 33 such as shown in FIG. 14 and each of them can contain a different kind of pill blister pack 30 similarly to the pill case 1 described above. When taking the pill case 1' out from the pill rack 33, the pill case 1' is pulled out toward the front side by fingers placed on the inclined face 14. By lifting upwardly a little and pulling forwardly the drawer 3 with fingers inserted into the space behind the front plate 15 and below the inclined face 14, the engagement claws 23 are released from the guides 7, so that the drawer 3 can be drawn. Even if the whole length of the blister packs 30 to be placed on the inclined face 9 of the bottom plate 6 is shorter than the length of the bottom plate 6, by choosing a pair of vertical groves 22 to be inserted the movable wall 21 for separating the storing space so that the usable depth of the inclined face 9 becomes approximately same as the length of the blister packs 30, the blister packs 30 can be placed with the front ends of the blister packs 30 aligned with the front edge of the bottom plate 6, facilitating picking blister packs up.

In the pill case 1', since the drawer 3 is drawn obliquely upwardly from the case body 2 along the inclined rear hole part 8A of the elongate hole 8 in parallel with the bottom plate 6, a gap between the bottom plate 6 and the rear wall 12 of the drawer 3 will not enlarge even in a state that the drawer 3 is drawn out. And the horizontal front hole part 8B of the elongate hole 8 allows the drawer 3 to be drawn keeping a horizontal attitude without inclining to the direction of the rear hole part 8A and causes the gap between the bottom plate 6 and the rear wall 12 to be kept small. This prevents the description or others to be contained in the second storage part 18 from catching into the gap between the bottom plate 6 and rear wall 12 or dropping over into the back side of the drawer 3.

As the drawer 3 is push to close it, the engagement claws 23 of the drawer 3 climb over the claw shaped guides 7 of the left and right side walls 2*a*, 2*b* and then engage with the back edges of guides 7 in a state that the drawer 3 is closed. Therefore the drawer 3 should be pull forwardly with the front of the drawer 3 lifted preventing the drawer 3 from dropping out from the case body 2 when the drawer 3 is placed and taken out from the pill rack 33.

Thanks to a fact that the left and right side walls 4*a*, 4*b* have a shape that the upper portion of the front part 4B is cut away widely, the left and right side walls 4*a*, 4*b* doesn't exist both sides of the front portion of the pill blister packs 30, even if the pill blister packs 30 placed on the inclined face 9 of said bottom plate 6 occupy the full width of the inclined face 9, therefore the pill blister packs 30 can be picked up by fingers inserted into such spaces. Also the pill blister packs 30 can be picked up by fingers inserted above and below the front portion of the pill blister packs 30. Thus an operator can take the pill blister packs 30 out in an easier way depending on the position of the pill case 1' placed or the posture of the operator.

FIG. 14 shows a pill case 1" as a third embodiment according to the present invention. It has only one difference from the second embodiment in a shape of the separation plate 16. The separation plate 16 in this embodiment has an inclined part 16*a* extending from the bottom plate of the second storage part 18 to the middle of the separation plate 16 and jointing them with a smooth rounded surface. Since the pill case 1" in this embodiment has the inclined part 16*a*, a description or others stored in the second storage part 18 can be taken out easily.

As clear from the above description, in the pill case 1' according to the present invention, it is possible to add the novel function to store the description of the pill or others into the second storage part 18 of the drawer 3 without any change in whole shape, and also possible to place the pill blister packs 30 so as to easily take out in spite of the shape there of.

What is claimed is:

1. A pill case comprising left and right side walls, a rear wall continued from said left and right side walls and a bottom plate provided between said left and right side walls in the upper position of the lower ends of said left and right side walls having an inclined face obliquely upwardly inclined toward the front side from said rear wall, and said pill case storing blister packs put on said inclined face of said bottom plate, characterized in that a drawer is placed in a space positioned below said bottom plate and defined by said side walls and said bottom plate so that said drawer can be drawn toward the front side.

2. A pill case as in claim 1 characterized by guides provided at the lower end of said left and right side walls to support said drawer from below.

3. A pill case as in claim 1 characterized by a separating plate provided to separate an inner space of said drawer into a first storage part being in front of the front edge of said bottom plate and a second storage part below said bottom plate with said drawer put into said pill case.

4. A pill case as in any one of claims 1 to 3 characterized by protrusions provided on both side walls of said drawer and elongate holes formed on said side walls in the drawing direction of said drawer to engage with said protrusions of said drawer.

5. A pill case as in claim 4 characterized in that said elongate holes are inflected so that said elongate holes comprise a rear hole part inclined parallel with said bottom plate and a front hole part extending horizontally from the front end of said rear hole part.

6. A pill case as in any one of claims 1 to 5 characterized by an engagement portion provided on said left and right side walls or said bottom plate, and a latch portion provided on said drawer, said latch portion engaging with said engagement potion in a state of that said drawer is closed.

7. A pill case as in any one of claims 1 to 6 characterized in that said left and right side walls each comprises a rear part, a front part having a height of about half of said rear part and step part between said rear part and said front part, wherein said step part is placed at a position ⅓ to ½ of the total length of said bottom plate from the front edge of said bottom plate.

8. A pill case as in any one of claims 1 to 7 characterized by at least one pair of opposed vertical groves formed on inside of said left and right side walls and a movable wall which engages with said vertical groves to separate the space above said inclined face of said bottom plate into a front space and a rear space.

* * * * *

UNITED STATES PATENT AND TRADEMARK OFFICE

CERTIFICATE OF CORRECTION

PATENT NO. : 6,971,522 B2
APPLICATION NO. : 10/516341
DATED : December 6, 2005
INVENTOR(S) : Shoji Yuyama et al.

It is certified that error appears in the above-identified patent and that said Letters Patent is hereby corrected as shown below:

Title Page #57

IN THE ABSTRACT

Line 1, change "in" to --In--.

IN THE CLAIMS

Col. 7, line 24 change "any one of claims 1 to 3" to --claim 1--.

Col. 8, line 6 change "any one of claims 1 to 5" to --claim 1--.

Col. 8, line 11 change "any one of claims 1 to 6" to --claim 1--.

Col. 8, line 18 change "any one of claims 1 to 7" to --claim 1--.

IN THE SPECIFICATION

Column 1, line 32, change "Japanese." to --Japanese--.

Column 3, line 42, change "6f" to --of--.

Signed and Sealed this

Twelfth Day of September, 2006

JON W. DUDAS
*Director of the United States Patent and Trademark Office*